US007007474B1

(12) United States Patent
Ochs et al.

(10) Patent No.: US 7,007,474 B1
(45) Date of Patent: Mar. 7, 2006

(54) ENERGY RECOVERY DURING EXPANSION OF COMPRESSED GAS USING POWER PLANT LOW-QUALITY HEAT SOURCES

(75) Inventors: Thomas L. Ochs, Albany, OR (US); William K. O'Connor, Lebanon, OR (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 10/309,287

(22) Filed: Dec. 4, 2002

(51) Int. Cl.
*F01K 7/34* (2006.01)

(52) U.S. Cl. ..... 60/653; 60/679

(58) Field of Classification Search ..... 60/653, 60/677, 679
See application file for complete search history.

(56) References Cited

U.S. PATENT DOCUMENTS

| | | | | |
|---|---|---|---|---|
| 2,677,236 | A | 5/1954 | Grinstead | |
| 3,736,745 | A | 6/1973 | Karig | |
| 3,826,091 | A * | 7/1974 | Stahl | 376/402 |
| 4,126,000 | A | 11/1978 | Funk | |
| 4,148,185 | A | 4/1979 | Somers | |
| 4,487,139 | A | 12/1984 | Warner | |
| 4,498,289 | A | 2/1985 | Osgerby | |
| 5,175,995 | A | 1/1993 | Pak et al. | |
| 5,344,627 | A * | 9/1994 | Fujii et al. | 423/220 |
| 5,467,722 | A | 11/1995 | Meratla | |
| 5,480,619 | A | 1/1996 | Johnson et al. | |
| 5,567,215 | A | 10/1996 | Bielawski et al. | |
| 5,570,578 | A * | 11/1996 | Saujet et al. | 60/647 |
| 5,582,807 | A | 12/1996 | Liao et al. | |
| 5,607,011 | A | 3/1997 | Abdelmalek | |
| 5,724,805 | A | 3/1998 | Golomb et al. | |
| 5,846,301 | A | 12/1998 | Johnson et al. | |
| 6,125,634 | A * | 10/2000 | Wittchow | 60/678 |
| 6,196,000 | B1 | 3/2001 | Fassbender | |
| 6,202,574 | B1 | 3/2001 | Liljedahl et al. | |
| 6,269,624 | B1 | 8/2001 | Frutschi et al. | |
| 6,588,212 | B1 * | 7/2003 | Wallace et al. | 60/772 |
| 6,596,780 | B1 * | 7/2003 | Jahnke et al. | 518/700 |

OTHER PUBLICATIONS

Steam, Its Generation and Use, Stultz, S.C.; Kitto, John B. Babcock & Wilcox Company, Ch 33, 34 & 35.

* cited by examiner

*Primary Examiner*—Hoang Nguyen
(74) *Attorney, Agent, or Firm*—Mark F. LaMarre; Mark P. Dvorscak; Paul A. Gottlieb

(57) ABSTRACT

A method of recovering energy from a cool compressed gas, compressed liquid, vapor, or supercritical fluid is disclosed which includes incrementally expanding the compressed gas, compressed liquid, vapor, or supercritical fluid through a plurality of expansion engines and heating the gas, vapor, compressed liquid, or supercritical fluid entering at least one of the expansion engines with a low quality heat source. Expansion engines such as turbines and multiple expansions with heating are disclosed.

20 Claims, 3 Drawing Sheets

SINGLE STAGE TURBO–EXPANSION (NO HEATING)

DOUBLE EXPANSION WITH INTER–HEATING

DOUBLE EXPANSION DOUBLE HEAT

TRIPLE EXPANSION WITH TRIPLE HEAT

ENERGY RECOVERY DURING EXPANSION OF COMPRESSED GAS USING POWER PLANT LOW-QUALITY HEAT SOURCES

CONTRACTUAL ORIGIN OF THE INVENTION

The United States Government has rights in this invention pursuant to employer/employee agreements between the U.S. Department of Energy (DOE) and the inventors.

BACKGROUND OF THE INVENTION

This invention relates to a new process for recovering energy from a compressed gas (such as compressed flue gas) which has been cooled and is then reheated using low-quality heat sources such as circulating water in a power plant and then expanded through a turbine (or other expansion engine), to recover the energy in the heated compressed gas stream.

The need for separation of carbon dioxide or other vapor constituents such as sulfur dioxide or water (in this invention the term "vapor" can represent any condensable gas) from a flue gas stream may involve compression of that flue gas stream and cooling of the stream to condense the vapor. Once a portion of the vapor has been removed through condensation, the remaining gas stream can have energy recovered from it by expansion through an expansion engine (such as a turbine). Presently, high-concentration carbon dioxide gas streams are treated using compression and cooling to obtain liquid and solid $CO_2$ in industry. However, the expansion of the resulting waste gas stream, which is cold and depleted in $CO_2$ content, is not used effectively for energy recovery and the use of low-quality heat sources to heat that gas stream for enhanced energy recovery is not applied.

There is now a growing interest in a method to remove $CO_2$ and other vapors from the flue gas stream at power plants or other industrial combustion facilities (to slow the increase in concentration of atmospheric greenhouse gases and to remove other local pollutants) which will also increase the cost of gas-stream processing. The present invention recovers revenue in the form of otherwise lost energy in the cold compressed gas stream.

The energy recovered can help offset the extra energy required for the additional compression used for more complete separation of the vapors or if the components of the flue gas are required at high pressure such as in a process for mineral carbonate sequestration, injection into saline aquifers, reactions with brines, enhanced natural gas recovery, or other sequestration methods. This is different from the prior art as now practiced where the state of-the-art processes for compression separation of more dilute gases are significant net energy users, see our co-pending patent application entitled "Compression Stripping of Flue Gas with Energy Recovery", filed Dec. 4, 2002, Ser. No. 10/309,251, by the inventors of this application the entire disclosure of which is incorporated by reference. GE-Enter Software's power plant modeling package "GateCycle" was used to model this invention as well as our co-pending application.

SUMMARY OF THE INVENTION

An object of this invention is to provide a method of recovering energy from a cold compressed gas by incrementally expanding the compressed gas through a plurality of expansion engines and heating the gas entering at least one of the expansion engines with a low quality heat source.

Another object of the present invention is to provide a method of recovering energy from a compressed remediated flue gas substantially free of carbon dioxide, sulfur dioxide, and water, wherein the gas is at a pressure of not less than about 1,000 psia, by incrementally expanding the compressed gas through a plurality of turbines and heating the cold gas entering at least one turbine by passing the gas in heat exchange relationship with a low quality source of heat wherein the temperature of the low quality source of heat is less than approximately 250° C.

The invention consists of certain novel features and a combination of parts hereinafter fully described, and particularly pointed out in the appended claims, it being understood that various changes in the details may be made without departing from the spirit, or sacrificing any of the advantages of the present invention.

DETAILED DESCRIPTION OF THE PRESENT INVENTION

Figure 1:
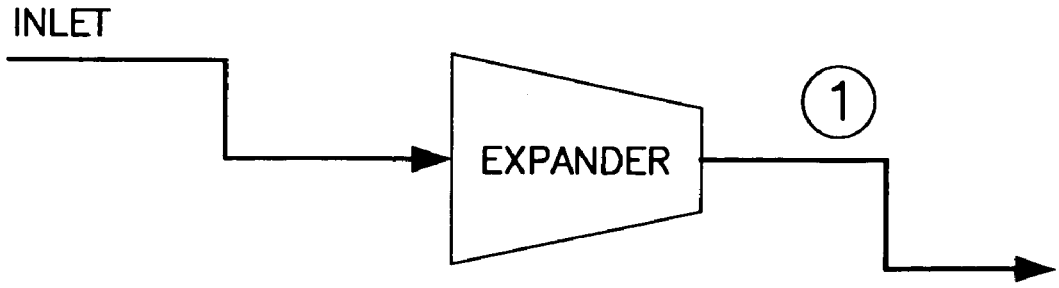
FIG. 1 is a schematic representation of a single stage expansion without heating.
Figure 2:
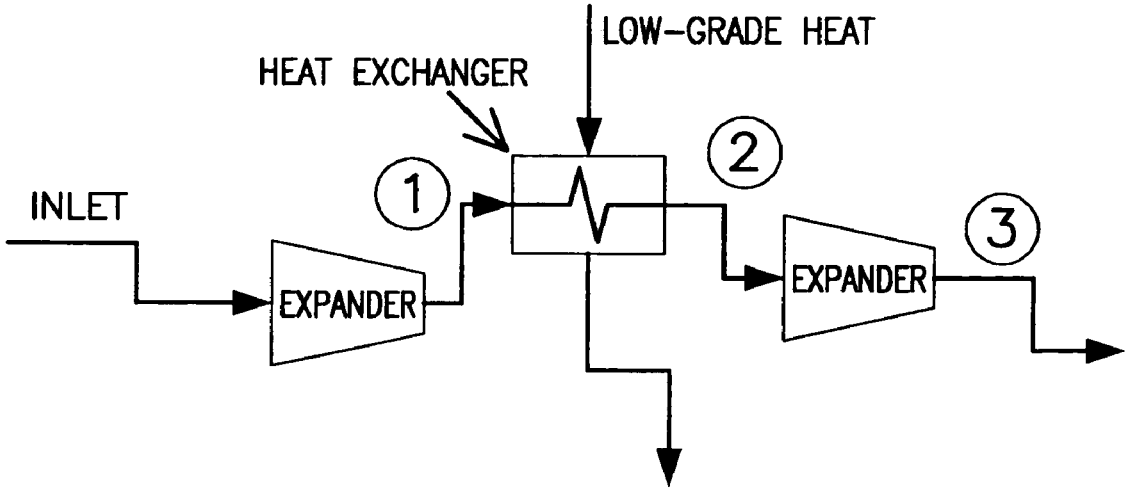
FIG. 2 is a schematic representation of a double expansion with heating in between the expansions.
Figure 3:
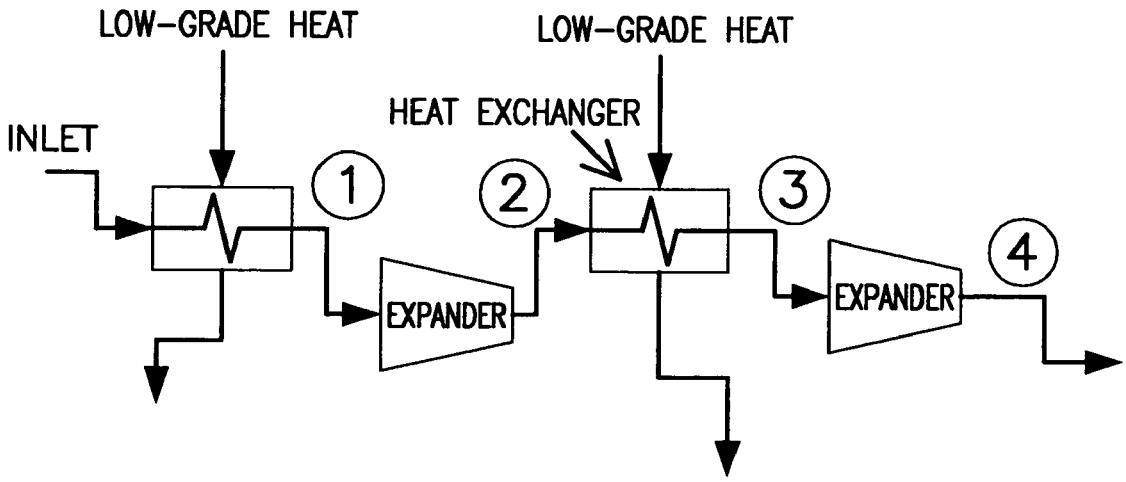
FIG. 3 is a schematic representation of a double expansion and double heat process.

This invention starts after a gas stream has been compressed and cooled to condense vapor components. In one aspect of the invention a cool high-pressure gas stream is heated using the exit cooling water from a power plant condenser (or other comparable low-quality heat source.) The compressed warm gas is then sent through an expansion engine (such as a turbine) to recover the energy.

Three applications of this invention are set forth, but it should be readily apparent to those skilled in the arts that there are other applications of the invention.

In the first application, the invention is used in the setting of a fossil fueled steam power plant using flue gas recirculation, oxygen injection, and flue gas compression and cooling to recover $CO_2$ and pollutants. The cooled, compressed, $CO_2$, $SO_2$, and $H_2O$ depleted gas is sent through a heat exchange process with the circulating water (the condenser cooling water for a power plant), and then to the first stage of a 4 stage expander where the available energy is extracted as useful work. At the end of the first stage (after expansion) the temperature of the expanded gas has dropped (due to the expansion) to well below zero ° C. (the temperature is dependant on the temperature of the gas before the expander). The cooled gas is then heated again using circulating water (the condenser cooling water for a power plant) after it has passed through the power plant condenser, and the heated gas is then expanded through the second stage of the turbine. This is repeated through each stage of the expansion.

Based on analyses of the effect of the heating, the expanded gas can recover a substantial amount of extra energy due to the heating. The actual amount of extra energy will depend on the temperature of the gas before and after expansion and the pressure differential between the incoming gas and the expansion engine discharge pressure. As an example, if the temperature were to be raised from −20° C. to +25° C., approximately an 18% gain could be expected in energy recovered through a turbine expander (due to the ratio of the absolute input temperatures).

Since the energy used in this example comes from the cooling water for the condenser in a fossil fuel power plant or from flue gas condensate, this energy is otherwise considered waste heat and must be discharged into the environment. In this invention, the water can lose energy to the cooled gas stream and enhance the energy recovery.

In a second application, the invention is used in an industrial process environment where the low quality heat from industrial processes is used to add energy to the expanding gas stream.

In a third application, the invention is used in any combustion system and the recovered heat from any process can be used to enhance the recovery of energy through expansion.

In our co-pending application, the gas leaves the final heat exchanger at a temperature of 79° F., a pressure 5,040 psia and at a flow rate of 32.5 tons per hour. In the example set forth in Table 1, low quality heat is obtained from warm fluid streams that cannot be recovered easily in other power cycle fluids. In the case of these examples the low-quality heat is supplied at approximately 150° F. from fluids used to cool other parts of the cycle. If the temperature of the low-quality heat source is higher, then power generated is increased.

FIGS. 1–4 are self explanatory. The expander may be a turbine or other expansion engine. The inlet gas to an expander is heated by passing the gas in heat exchange relationship with a low quality heat source, low quality being hereinafter defined. As the number of expansions and inter-heating increase, so does the power output. However, the incremental increase in power diminishes as the number of expansions increase. So economics dictate the number of expansion-heating cycles for each set of inlet conditions of temperature, pressure and flow rate.

Referring now to Table 1, there is disclosed the energy obtained from incrementally expanding a compressed gas at a starting temperature of 79° F. and at a pressure of 5,040 psia. As illustrated in the table significantly more energy is obtained with incremental expansions and initial and intermediate heating. The invention encompasses at least two expansions and one initial heating and one intermediate heating. The heating has to be with a low quality heat source hereafter as defined wherein the difference in between the gas being heated and temperature of the heat source is less than about 350° C. Alternatively, low quality heat can be defined as a source temperature of less than about 250° C. The invention also encompasses the specific examples shown in FIGS. 1 to 4 wherein the compressed gas is both heated and expanded at least twice and wherein the compressed gas is expanded at least three times and heated at least twice. The expansion may be in a turbine or other expansion engine.

Figure 4:
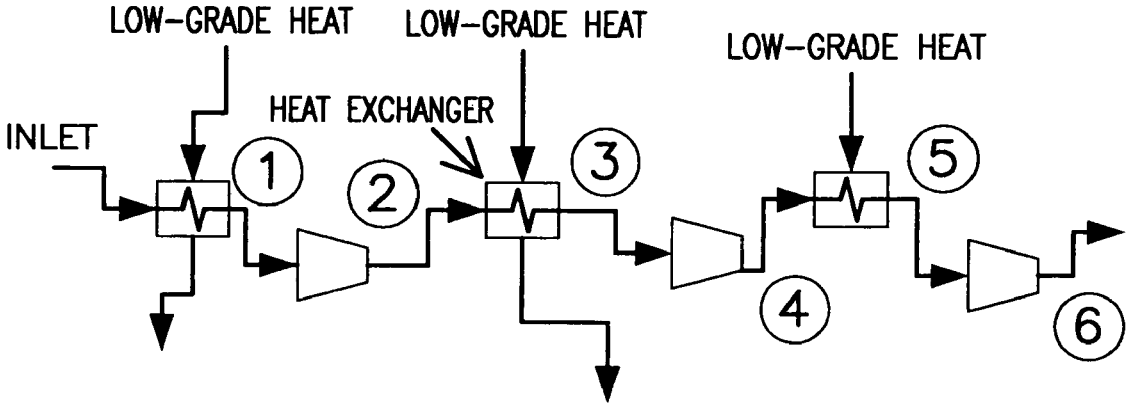
FIG. 4 is a schematic representation of a triple expansion with triple heat.
Figure 5:
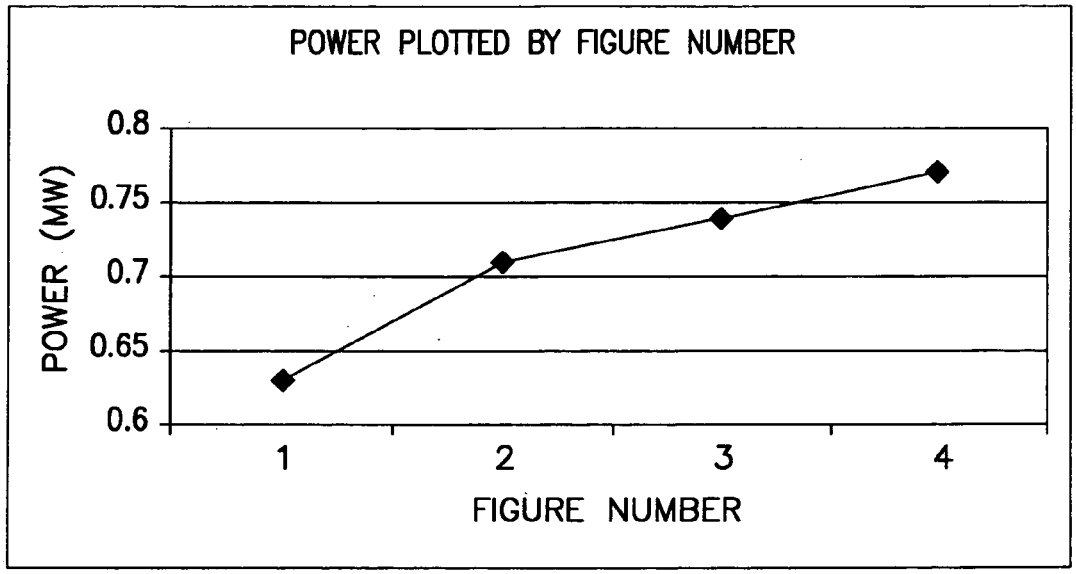
FIG. 5 is a graphical representation of the relationship between power and the processes disclosed in FIGS. 1 through 4.

In the examples shown in FIGS. 1 through 4 there is approximately 0.14 MW increase for inter-heating the expansion by only approximately 56° F. If the temperature can be raised more, the power is also increased. As an example, if the low-grade heat source in FIG. 4 is 250° F. instead of 150° F. the power increases from 0.77 MW to approximately 0.90 MW which is an increase of 0.13 MW. Comparing it to the expansion without any inter-heating the increase is approximately 0.27 MW. Table 1 compares the results for each configuration illustrated in FIGS. 1–4. Table 2 lists the gas constituents.

TABLE 1

Gas path temperatures and pressures

| FIG. | Power (MW) | T-1 (° F.) | P-1 (psia) | T-2 (° F.) | P-2 (psia) | T-3 (° F.) | P-3 (psia) | T-4 (° F.) | P-4 (psia) | T-5 (° F.) | T-6 (° F.) | P-6 (psia) |
|---|---|---|---|---|---|---|---|---|---|---|---|---|
| 1 | 0.63 | −76 | 1,200 | | | | | | | | | |
| 2 | 0.71 | 21 | 3,120 | 124 | 3,120 | 6 | 1,200 | | | | | |
| 3 | 0.74 | 135 | 5,040 | 72 | 3,120 | 134 | 3,120 | 15 | 1,200 | | | |
| 4 | 0.77 | 135 | 5,040 | 96 | 3,760 | 139 | 3,760 | 83 | 2,480 | 143 | 49 | 1,200 |

In all cases the inlet conditions are the same: T=79° F., P=5,040 psia, and the mass flowing is approximately 32.5 ton/hour. The gas composition is as follows:

TABLE 2

Gas content

| Gas | Mole Fraction |
|---|---|
| $O_2$ | 0.47 |
| $N_2$ | 0.24 |
| $CO_2$ | 0.29 |
| $H_2O$ | Trace |

The concept of the present invention is not difficult for a person of ordinary skill in the art to understand. The invention revolves around the discovery that incrementally expanding a compressed gas while heating prior to the expansions, using waste heat, provides more net work than simply expanding all at once or incrementally expanding without heating, and is more efficient than using high quality heat sources for the heating (said high quality sources having the potential to be used in other forms of energy service). Moreover, the invention is practical and useful because of the use of low quality heat as a heating medium prior the expansion steps. In general, the use of low quality or what would be considered waste heat in a normal fossil fuel power plant is one of the unique aspects of the invention. To define low quality, or low grade or waste heat, there are two issues involved in rating a heat source. The first is the temperature difference between the heat source and the sink. This temperature difference drives heat transfer between the hot source and the cold sink when trying to move heat from one fluid to another. The second is the quantity of heat that a source carries. If the temperature of the source is near the temperature of the sink, then the source is considered a "low quality heat source" independent of the amount of heat that might be carried in that source. The reason for it being considered low quality is that it is difficult to transfer significant quantities of heat without massive heat transfer surfaces when the temperature difference is small. It is also difficult to generate useful work from the source since the relationship of the source temperature to the sink temperature defines the efficiency of changing heat into work in a combustion turbine, (Brayton Cycle) or steam turbine (Rankine Cycle). The definition of "low quality" heat in the present invention as stated above is when the temperature of the heat source is less than about 250° C. or if the difference between the sink and the heat source is less than about 350° C.

For instance, in a power plant environment, there is the circulating water which is generally considered to be unusable as a heat source (however, its mass and heat capacity make it a great heat sink). The circulating water is generally at a temperature approaching the environment when it goes into a condenser and it comes out approximately 5° C. to 12° C. hotter than when it went in. If a portion of the circulating water is then diverted to the auxiliary cooling system, it can pick up another 10° C. to 15° C. in that circuit. These temperatures seem to be very close to ambient and of little value; however, the flows are very high and the amount of heat (as opposed to the temperature of the source) in the fluid is generally in excess of the electrical power produced in the plant. This invention can employ the modest temperature differences of the circulating water, that is, 5° C. to about 35° C. difference between the temperature of the circulating water and the ambient working fluid because the flows are so large and the cooled $CO_2$, $SO_2$, and $H_2O$ depleted flue gas temperature is low (as low as −100° C.). By using the large volume of flow to raise the temperature of the fluid between expansion stages, the temperature of the circulating water will change very little. The temperature change of the fluid prior the expansion stages can be significant. In another example, flue gas is discarded in a power plant generally at a temperature of approximately 200° C. The flue gas can be used as a source of "low quality" heat. In another example, extraction steam at temperatures as low as 75° C. is used for heating feed water in a power plant and the extraction steam could also be used as a "low quality" heat source in the present invention.

Since the invention encompasses the use of a compressed gas, the issue is how compressed is compressed or what does the term compressed mean in the circumstance of the present invention. The energy in an expanding fluid is used to drive an expansion engine such as a turbine. There are two components that are used to derive work in a turbine. The first is heat energy (enthalpy) which covers both internal energy and "PV" (pressure times volume) energy. The other form of energy in the fluid is the kinetic energy (or velocity and mass of the gas). In most practical turbine systems the velocity energy is considered small with respect to the enthalpy. The turbine extracts most of its energy from the gas by reducing the enthalpy as the gas moves through the blades. The work performed is proportional to the enthalpy reduction. The greater the enthalpy difference between the incoming gas stream and the leaving stream, the more work that is done. In the specific example illustrated, the incoming pressure is approximately 5,040 psia and the leaving pressure is approximately 1,200 psia. If we examine the enthalpy of the system we can, as an example, if we start with a gas that has an initial enthalpy of approximately −42.22 BTU/lb at 79° F. and 5,040 psia we can expand it through a turbine with an insentropic efficiency of 0.9 and have it come out at approximately −64.266 BTU/lb at −63° F. and 1,200 psia for a difference of approximately 22.046 BTU/lb. Using the example of 32.5 ton/hour of gas expanding through this turbine we will obtain approximately 0.41 MW of electricity from a turbo-generator. The reason for a high initial pressure is that in our co-pending application, we condensed out as much of the $CO_2$ as possible and to do that at a given temperature we increased the total pressure (to approximately 5,000 psia in one example in that application) which increases the partial pressure of the condensing vapor. During our expansion through a turbine, the reduced temperature of the gas can condense out even more of the remaining $CO_2$. In another example, we can use the same fluid flow at the same initial temperature starting at 2,500 psia and expanding to 1,200 psia through the same turbine. In this case, the starting temperature is also 79° F. and the enthalpy is approximately −27.24 BTU/lb. After the expansion the temperature is approximately −10° F. and the enthalpy is approximately −39.88 BTU/lb. The difference in enthalpy in this case is approximately 12.64 BTU/lb and the power generated is only approximately 0.236 MW. The difference in pressure is reflected as a difference in enthalpy for a real gas and the expansion across the turbine extracts more work from the more highly compressed gas. Accordingly, for the purposes of the present invention, the term "compressed" includes gas that is compressed to at least 1,000 psia and includes gases of higher pressures such as not less than about 5,000 psia in the example illustrated in the present invention.

The invention has particular but not exclusive application to power plants. More particularly to power plants to which compression stripping of $CO_2$ from flue gas is employed. The low quality heat can be provided from cooling water in a power plant or from flue gas condensate in a power plant or with any fluid available in the power plant which has sufficient temperature differential and/or flow rate to raise the temperature of the fluid prior to expansion steps in a manner sufficient to provide added energy as disclosed in this invention.

This process can also be applied to the liquid/vapor/supercritical $CO_2$ stream produced in compression stripping of flue gas. If the $CO_2$ is above the critical temperature (31.05° C.–87.89° F.) and pressure (75.27 atm–1106 psia) it will be considered a supercritical fluid and can be considered to behave as a fluid wherein the invention behaves as with other fluids expanding through an expansion engine as known to those skilled in the art. If the $CO_2$ is below the critical temperature but above the critical pressure it can have the temperature raised through exchange with a low quality heat source and be transformed into a supercritical fluid for expansion through an expansion engine. If the $CO_2$ is in liquid form it can be transformed into a compressed vapor by boiling using a low quality heat source and the compressed vapor can be expanded through an expansion engine.

While there has been disclosed what is considered to be the preferred embodiments of the present invention, it is understood that various changes in the details may be made without departing from the spirit or scope of the present invention or sacrificing any advantages of the present invention, the extent to which is defined in the claims appended hereto.

We claim:

1. A method of recovering energy from a compressed gas, comprising incrementally expanding the compressed gas through a plurality of expansion engines and heating the gas entering at least one of the expansion engines with a low quality heat source, wherein the gas entering the expansion engines and the low quality heat source are less than about 250° C.

2. The method of claim 1, wherein the compressed gas is heated at least once after expansion.

3. The method of claim 1, wherein the compressed gas is both heated and expanded at least twice.

4. The method of claim 1, wherein the compressed gas is expanded at least three times and heated at least twice.

5. The method of claim 1, wherein the energy is recovered in a power plant and at least some of the expansion engines are turbines.

6. The method of claim 1, wherein the compressed gas is provided by the compression stripping of $CO_2$ from flue gas in a power plant.

7. The method of claim 6, wherein the compressed gas for the power plant is at a pressure of not less than about 1,000 psia.

8. The method of claim 6, wherein the compressed gas from the power plant is at a pressure of not less than about 5,000 psia.

9. The method of claim 6, wherein the low quality heat is provided from a cooling water in a power plant.

10. The method of claim 9, wherein the low quality heat is provided from a flue gas condensate in a power plant.

11. The method of claim 9, wherein the temperature difference between the low quality heat source and the gas being heated therewith is less than about 350° C.

12. A method of recovering energy from a compressed remediated flue gas substantially free of $CO_2$, $SO_2$ and $H_2O$ at a pressure of not less than about 1000 psia, comprising incrementally expanding the compressed gas through a plurality of turbines and heating the gas entering at least one turbine by passing the gas in heat exchange relationship with a low quality source of heat wherein the temperature differential between the gas and the low quality source of heat is less than about 350° C.

13. The method of claim 12, wherein the low quality heat source is a liquid in a fossil fuel power plant.

14. The method of claim 13, wherein the compressed gas is heated at least once prior to expansion.

15. The method of claim 14, wherein the compressed gas is at a pressure not less than about 5000 psia.

16. The method of claim 15, wherein the compressed gas is a remediated flue gas from a fossil fuel power plant.

17. A method of recovering energy from a compressed remediated $CO_2$ supercritical fluid, liquid, or vapor stream, comprising:

incrementally expanding the compressed supercritical-fluid/vapor/liquid through a plurality of turbines and heating the vapor/liquid entering at least one turbine by passing the supercritical-fluid/liquid/vapor in heat exchange relationship with a low quality source of heat wherein the temperature differential between the supercritical-fluid/liquid/vapor and the low quality source of heat is less than about 350° C. and the remediated $CO_2$ is at a pressure of not less than about 1106 psia.

18. The method of claim 17, wherein the low quality heat source is a cooling liquid in a fossil fuel power plant.

19. The method of claim 18, wherein the compressed supercritical-fluid/liquid/vapor is heated at least once prior to expansion.

20. The method of claim 1, wherein the compressed gas are compressed flue gases.

* * * * *